United States Patent [19]

Korte et al.

[11] Patent Number: 4,528,994

[45] Date of Patent: Jul. 16, 1985

[54] TOBACCO TREATING PROCESS

[75] Inventors: Kevin R. Korte, Louisville, Ky.; Dan T. Wu, Surabaya, Indonesia

[73] Assignee: Brown & Williamson Tobacco Corporation, Louisville, Ky.

[21] Appl. No.: 562,254

[22] Filed: Dec. 16, 1983

[51] Int. Cl.[3] ..... A24B 3/18

[52] U.S. Cl. ..... 131/296; 131/300

[58] Field of Search ..... 131/296, 300

[56] References Cited

U.S. PATENT DOCUMENTS 3,214,928 11/1965 Oberdorfer ..... 131/900

4,235,250 11/1980 Utsch ..... 131/900

4,310,006 1/1982 Hibbitts et al. ..... 131/900

*Primary Examiner*—V. Millin

*Attorney, Agent, or Firm*—Charles G. Lamb

[57] ABSTRACT

An improved tobacco treating process wherein fill value improvement can be obtained with less energy and less carbon dioxide requirements comprising mixing tobacco with finely divided solid $CO_2$ at controlled preselected parts by weight, impregnating the mixture with carbon dioxide gas under preselected pressure conditions, releasing the pressure and subjecting the so treated tobacco to drying gases with temperatures at least above 250° F. with wet bulb temperatures in the range of at least about 150° F. to a maximum of 212° F.

9 Claims, 1 Drawing Figure

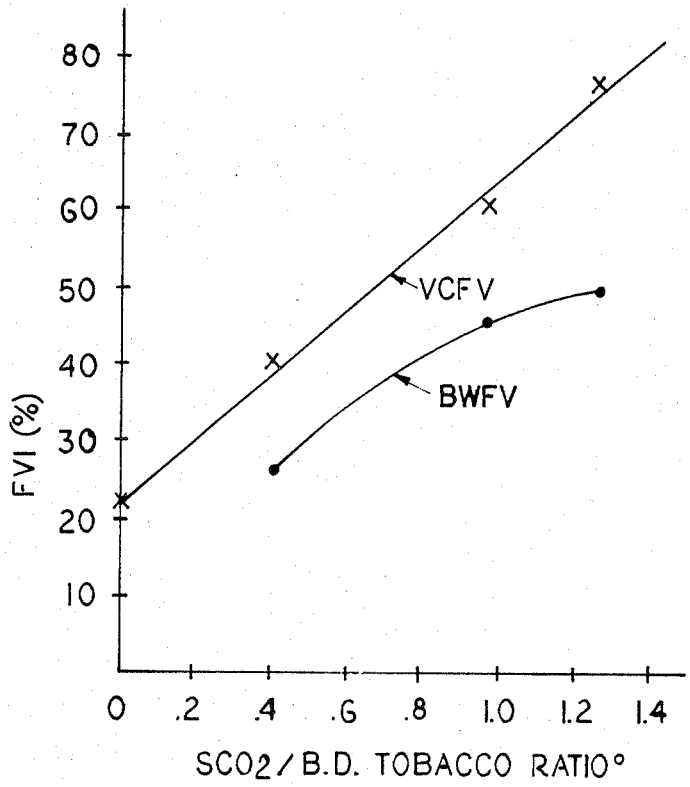
80
70
60
50
40
30
20
10
FVI (%)
VCFV
BWFV
0
.2
.4
.6
.8
1.0
1.2
1.4
SCO2/B.D. TOBACCO RATIO°

TOBACCO TREATING PROCESS

BACKGROUND OF THE INVENTION (1) Field of the Invention

The invention relates to tobacco treating processes and more particularly to an improved process for expanding and reducing the moisture content of tobacco.

(2) Brief Description of the Prior Art

It is known in the manufacture of smoking articles to expand tobacco utilizing carbon dioxide in both the liquid and pressurized gaseous states or only utilizing carbon dioxide in the pressurized gaseous state, to subsequently reduce the pressure to solidify the carbon dioxide within the tobacco structure, and to heat the tobacco to vaporize the solid carbon dioxide, while simultaneously drying and expanding the tobacco. For example, unexpired U.S. Pat. No. 4,235,250, inventor, Francis V. Utsch, and issued on Nov. 25, 1980 teaches treating tobacco with carbon dioxide gas at 250 psig, cooling the system to a selected carbon dioxide enthalpy, decreasing the pressure on the system and heating the system to expand the tobacco. Further, this patent, like unexpired U.S. Pat. Nos. 4,258,729 and 4,333,483, inventors, Roger Z. de la Burde, Patrick E. Aument and the same Francis V. Utsch, and issued on Mar. 31, 1981, and June 8, 1982 respectively, teach pre-snowing the tobacco with finely divided solid carbon dioxide prior to gaseous carbon dioxide treatment in amounts of 5–50% by weight of tobacco to increase the amount of carbon dioxide retained by the tobacco.

Unexpired U.S. Pat. No. 4,250,898, inventor, Francis V. Utsch et al and issued on Feb. 17, 1981, teaches a similar process to U.S. Pat. No. 4,235,250 of contacting tobacco with gaseous carbon dioxide at at least 50 psig pressure and cooling to solidification of the carbon dioxide.

Unexpired U.S. Pat. No. 4,336,814, inventor, Larry M. Sykes et al and issued on June 29, 1982, teaches impregnating tobacco with liquid carbon dioxide, solidifying the carbon dioxide and vaporizing the same to cause tobacco expansion.

Unexpired U.S. Pat. No. 4,340,073, inventor, Roger Z. de la Burde et al and issued on July 20, 1982, teaches impregnating tobacco with liquid carbon dioxide with the tobacco being maintained at temperatures no lower than about −20° C., solidifying the carbon dioxide and vaporizing the same to cause tobacco expansion.

The prior art practices have resulted in fill value improvement, but often requiring lengthy impregnations, elaborate and expensive equipment and substantial operating costs with concomitant losses in the desired chemical and physical properties of the final tobacco product.

In accordance with the process of the present invention an improved, homogenous tobacco product is obtained having a comparatively high fill value improvement with comparatively substantially equal or sometimes reduced losses of alkaloids and total sugars with the process requiring reduced treating time and reduced operating and material costs. Various other features of the present invention will become obvious to one skilled in the art upon reading the disclosure set forth herein.

SUMMARY OF THE INVENTION

More particularly the present invention provides an improved tobacco treating process wherein fill value improvement can be obtained with comparatively substantially equal or sometimes even lower alkaloids and total sugars losses comprising mixing tobacco with finely divided solid $CO_2$ at a preselected ratio of parts by weight to produce a fill value improvement in the final product of the process, treating the mixture with gaseous carbon dioxide at preselected pressure, reducing the gaseous pressure and drying the so treated tobacco with hot gases to arrive at the final expanded product of the process.

It is to be understood that various changes can be made by one skilled in the art in the seven steps of the inventive process disclosed herein without departing from the scope or spirit of the present invention. For example, in the first set of experiments described hereinafter, pressures for the gaseous carbon dioxide step of the inventive process were in the range of approximately 700 psig to 800 psig; the second set of experiments describe pressures for the gaseous carbon dioxide step to be in the approximate mid-400 psig range. Further, the tobacco drying step of the experiments described hereinafter is like that disclosed in unexpired U.S. Pat. No. 4,167,191, inventors, John N. Jewell et al and issued on Sept. 11, 1979, but any one of several other now well known tobacco drying/expanding steps could be utilized in the inventive process.

BRIEF DESCRIPTION OF THE DRAWING

The FIGURE presented is a graph depicting the fill value improvement under varying ratios by weight of solid carbon dioxide to tobacco treated in accordance with the inventive process.

TABLES 1 through 3 set forth below show the comparative experimental parameters (TABLE 1), the comparative physical results (TABLE 2), and the comparative chemical results (TABLE 3) on the experimental treatment of six comparable tobacco samples of a cut mixture of flue-cured and Burley tobaccos with a moisture content of approximately 20%. Column "A" in each of the three tables relates to a tobacco sample dried without pretreatment. Column "B" relates to a tobacco sample mixed with solid and powdered carbon dioxide or dry ice ($SCO_2$). Column "C" relates to a tobacco sample mixed in accordance with inventive process with solid and powdered carbon dioxide or dry ice and impregnated with gaseous carbon dioxide ($GCO_2$) under pressure. Column "D" and column "E" are the same as column "C" except helium (He) and nitrogen ($N_2$) respectively replace gaseous carbon dioxide. Column "F" relates to a conventional or known impregnation of a tobacco sample with carbon dioxide in the liquid state ($LCO_2$).

The solid carbon dioxide or dry ice was ground to powder form using a mortar and pestle before mixing with the tobacco sample to be tested. Advantageously, to obtain high fill value improvement in accordance with the present invention the solid carbon dioxide to dry tobacco ratio by weight was approximately 125%. The time the gaseous carbon dioxide was held in contact with the tobacco sample mixed with the solid carbon dioxide was approximately 2 minutes. All experiments in TABLES 1–3, except those under columns "A" and "B" were conducted in a pressure vessel at 700–800 psig in small 250–300 gram amounts in view of the capacity limitations of the vessel.

In the expansion/drying step, an expansion/drying process such as that disclosed in U.S. Pat. No. 4,167,191, inventors, John N. Jewell et al, issued Sept.

11, 1979 was utilized. This process comprises drying the expanded tobacco at a temperature within the range of from about 250° F. to about 650° F. in the presence of an absolute humidity at a level above that which will provide a wet bulb temperature of at least about 150° F. In the experiments of TABLES 1-3, the inlet dryer temperature was 600° F. with a wet bulb temperature of 210° F. A typical dryer and tangential separator arrangement similar to that disclosed in FIG. 1 of Jewell U.S. Pat. No. 4,167,191 was utilized with only one dryer chamber being used instead of three. The production rate was at a substantially equivalent rate. After drying, expanded samples were placed in a conditioning cabinet (75° F., 60%RH) to bring moistures to equilibrium conditions. The amount of carbon dioxide absorbed was determined by measuring the tobacco sample immediately after treatment and pressure reduction and comparing it to the weight one hour later.

TABLES 1-3 of these experiments are summarized as follows, the readings representing an average of 2 replicate runs for each treatment. All experiments were dried at approximately the same production rate.

son purposes and should be considered for relative rather than absolute value. It also should be remembered that the data of TABLES 1-3 is based on experiments conducted with very small tobacco samples and, in some instances does not as definitively reflect comparison differences as are reflected in later larger scale experiments reported hereinafter in TABLES 4-7.

From TABLE 2, it can be seen that among the three gases used for impregnation of a tobacco sample pretreated with solid carbon dioxide ($SCO_2$), only gaseous carbon dioxide gave the same fill value improvement as treatment with liquid carbon dioxide alone ($LCO_2$). This takes on particular significance since it was noted that less overall $CO_2$ was utilized and absorbed (TABLE 1) when the tobacco sample was first treated with solid carbon dioxide ($SCO_2$) and then treated with gaseous carbon dioxide ($GCO_2$) then when impregnated with liquid carbon dioxide alone even though fill value improvments were substantially the same. By such usage optimization of carbon dioxide, less energy was required in the drying step which otherwise would have been required to remove excessive $CO_2$ from the tobacco sample. Further, less energy also was required in separating the tobacco particles of a tobacco sample, which otherwise would become "rock hard" in the $LCO_2$ process due to inter-particle solid $Co_2$.

TABLE 1

| | EXPERIMENTAL PARAMETERS | | | | | |
|---|---|---|---|---|---|---|
| | "A" No Pre-Treatment | "B" $SCO_2$ | "C" $SCO_2/GCO_2$ | "D" $SCO_2/He$ | "E" $SCO_2/N_2$ | "F" $LCO_2$ |
| Impregnation Pressure (Psig) | — | — | 725 | 800 | 792 | 762 |
| Dryer | | | | | | |
| Inlet Temp (°F.) | 595 | 597 | 600 | 598 | 599 | 601 |
| Wet Bulb (°F.) | 210 | 210 | 210 | 210 | 210 | 210 |
| $CO_2$ Absorption | — | — | 4.5 | Trace | Trace | 19.4 |

TABLE 2

| | PHYSICAL PROPERTY SUMMARY | | | | | | |
|---|---|---|---|---|---|---|---|
| | Starting Material | "A" No Treatment | "B" $SCO_2$ | "C" $SCO_2/GCO_2$ | "D" $SCO_2/He$ | "E" $SCO_2/N_2$ | "F" $LCO_2$ |
| Moisture (%) | 22 | | | | | | |
| Exit Dryer | — | 7.1 | 9.2 | 5.7 | 7.4 | 7.1 | 7.3 |
| Cond. Product | 12.8 | 12.6 | 12.1 | 12.1 | 12.3 | 12.1 | 11.8 |
| Corrected VCFV (mg/cc) | 218 | 175 | 173 | 110 | 166 | 169 | 109 |
| VCFV (cc/gr) | 4.6 | 5.7 | 5.8 | 9.1 | 6.0 | 5.9 | 9.2 |
| FVI (Volumetric %) | (Control) | 25 | 26 | 98 | 31 | 29 | 100 |
| PSD (%) | | | | | | | |
| +6 Mesh | 24.6 | 24.4 | 19.8 | 17.0 | 19.5 | 22.1 | 14.5 |
| +9 Mesh | 46.7 | 43.1 | 37.6 | 38.4 | 37.8 | 40.9 | 36.2 |
| −14 Mesh | 16.8 | 21.8 | 26.3 | 26.3 | 25.7 | 23.6 | 22.4 |
| −28 Mesh | 1.8 | 2.8 | 3.7 | 3.7 | 3.8 | 2.9 | 2.4 |

TABLE 3

| | CHEMICAL PROPERTY SUMMARY | | | | | | |
|---|---|---|---|---|---|---|---|
| | Starting Material | "A" No Treatment | "B" $SCO_2$ | "C" $SCO_2/GCO_2$ | "D" $SCO_2/He$ | "E" $SCO_2/N_2$ | "F" $LCO_2$ |
| Alkaloid (%) | 3.20 | 2.82 | 2.89 | 2.43 | 2.81 | 2.85 | 2.56 |
| A.L. (%) | (Control) | 12 | 10 | 24 | 12 | 11 | 20 |
| Reducing Sugar (%) | 3.90 | 3.85 | 4.15 | 2.8 | 3.4 | 4.25 | 2.85 |
| Total Sugar (%) | 5.70 | 5.9 | 6.0 | 4.35 | 6.2 | 6.35 | 4.7 |
| Nitrate (%) | .75 | .76 | .72 | .82 | .74 | .74 | .82 |

The Vibrating Compression Fill Value (VCFV) test results shown in TABLE 2 is a constant force/variable volume method of measuring fill value and is reported in two ways at TABLE 2, namely, mg/cc and cc/gr.

In observing the data above and hereinafter, it should be remembered that such data is primarily for compari- From TABLE 2 it also can be observed that tobacco mixed with solid carbon dioxide but without gas impregnation (column "B") did not show any fill value improvement over the overdried product (colum "A") and that the helium (column "D") and nitrogen (column "E") impregnation on the solid carbon dioxide showed only slight fill value improvement over the overdried tobacco product but substantially less fill value improvement than the liquid carbon dioxide treated product (column "F").

From TABLE 3, it can be observed that the chemical property results under solid carbon dioxide/gaseous carbon dioxide tobacco product treatment (column "C") were not significantly different from those results of liquid carbon dioxide tobacco product treatment (column "F").

To verify the results of the experiments above set forth in TABLES 1-3 and to study the optimized solid carbon dioxide addition level using larger quantities of tobacco under the inventive process, a second set of experiments was conducted. TABLES 4 through 7 described hereinafter show the comparative experimental parameters (TABLE 4), comparative physical property summary (TABLE 5), comparative chemical property summary (TABLE 6), and, comparative cigarette property summary (TABLE 7) of the experimental treatment of four comparable tobacco samples of a cut mixture of flue-cured and Burley tobaccos with a moisture content of 22%. Three of the four samples were mixed with finely divided solid carbon dioxide at different ratios of parts by weight to show the comparative results when treated in accordance with the inventive process. Column "A" reflects a ratio by weight of 40% solid carbon dioxide to tobacco. Column "B" a ratio by weight of 96% and column "C" a ratio by weight of 128%. Column "D" reflects the results of the treatment of a comparable tobacco sample with the previously known liquid carbon dioxide process.

In the process of the comparable tobacco samples under columns "A", "B" and "C" of TABLES 4-7, the solid carbon dioxide ($SCO_2$) was ground to powder form using a Wiley Mill pulverizer (Standard Model No. 3, Arthur H. Thomas Co., Philadelphia, Pa.). The mixing of the solid carbon dioxide powder with the cut tobacco at the above described respective ratios by weight of 40%, 96% and 128% was accomplished in a rotating cement mixer. All gaseous carbon dioxide treatments under columns "A", "B" and "C" were run in a pressure vessel with the tobacco samples being in the range of 5 to 10 pound amounts in contrast with the range of 250-300 grams tobacco sample amounts run in the aforedescribed pressure vessel of TABLES 1-3. Treatments were in the mid-400 psig pressure range with gaseous contact being maintained for approximately 2 minutes. As before described, the amount of carbon dioxide absorbed was determined by measuring the weight of the impregnated tobacco immediately after gaseous pressure reduction and comparing it to the weight one hour later.

Once again, in the expansion/drying step an expansion/drying process like that disclosed in U.S. Pat. No. 4,167,191 was utilized. The inlet dryer temperature was 660° F. A wet bulb temperature at 210° F. was maintained and the production rate averaged 25 bone dry pounds per hour. A small scale dryer and tangential separator arrangement with one dryer chamber was utilized. Following drying/expansion, the dried tobacco was reordered in a rotating cylinder with water spray to a final moisture content of approximately 13% by weight.

The Vibrating Compression Fill Value (VCFV) test results shown have been described above.

The Borgwaldt Fill Value (BWFV) tests results were obtained by compressing a defined weight of test tobacco in a cylinder under a 3 Kg (free-fall) load for a duration of 30 seconds. Sample weight and height of the compressed tobacco column serve to calculate filling power expressed in cc/gr.

TABLE 7 represents the results of cigarette property measurements.

The results of the tests reported in tables 4-7 are as follows:

TABLE 4

| EXPERIMENTAL PARAMETERS | $SCO_2/GCO_2$ | | | $LCO_2$ |
|---|---|---|---|---|
| | "A" 40% | "B" 96% | "C" 128% | "D" (control) |
| Impregnation | | | | |
| Gas Pressure (PSIG) | 445 | 435 | 439 | — |
| Liq. Pressure (PSIG) | — | — | — | 464 |
| Hold Time (min.) | 2 | 2 | 2 | 2 |
| $CO_2$ Absorption (%) | 0.5 | 4.4 | 7.4 | 22.6 |
| Dryer | | | | |
| Inlet Temp. (°F.) | 664 | 660 | 663 | 663 |
| Wet Bulb (°F.) | 210 | 210 | 210 | 210 |
| Prod. Rate (bdp/hr.) | 26.5 | 25.3 | 24.5 | 26.2 |

TABLE 5

| PHYSICAL PROPERTY SUMMARY | STARTING MATERIAL | "A" 40% | "B" 96% | "C" 128% | "D" $LCO_2$ |
|---|---|---|---|---|---|
| Moisture (%) | 22.2 | | | | |
| Exit Dryer | | 4.7 | 4.0 | 4.1 | 4.5 |
| Reordered | | 13.1 | 12.7 | 11.9 | 13.9 |
| BFV (cc/gr) | 4.46 | 5.63 | 6.46 | 6.71 | 6.62 |
| at (% Moist.) | (14.0) | (14.3) | (13.7) | (13.5) | (13.7) |
| FVI (%) | Control | 26 | 45 | 50 | 48 |
| VCFV (mg/cc) | 228 | 163 | 142 | 130 | 133 |
| at (% Moist.) | (13.3) | (13.3) | (12.6) | (12.6) | (13.0) |
| FVI (%) | Control | 40 | 61 | 75 | 71 |
| PSD (%) | | | | | |
| +6 Mesh | 44.1 | 26.9 | 19.5 | 14.7 | 14.5 |
| +9 Mesh | 68.2 | 45.5 | 41.8 | 36.7 | 36.9 |
| −14 Mesh | 11.0 | 19.8 | 24.9 | 25.8 | 22.9 |
| −28 Mesh | 0.5 | 1.5 | 1.9 | 1.8 | 2.0 |

TABLE 6

| CHEMICAL PROPERTY SUMMARY | STARTING MATERIAL | "A" 40% | "B" 96% | "C" 128% | "D" $LCO_2$ |
|---|---|---|---|---|---|
| Alkaloids (%) | 3.33 | 2.75 | 2.71 | 2.60 | 2.65 |
| A.L. (%) | | −17 | −19 | −22 | −20 |
| Reducing Sugar (%) | 5.42 | 4.60 | 4.60 | 4.30 | 4.30 |
| R.S.L. (%) | | −15 | −15 | −21 | −21 |
| Total Sugar (%) | 6.33 | 5.60 | 5.50 | 5.10 | 5.00 |
| T.S.L. (%) | | −12 | −13 | −19 | −21 |
| Nitrate (%) | 1.21 | 1.26 | 1.32 | 1.31 | 1.32 |

TABLE 7

| CIGARETTE PROPERTY SUMMARY | "A" 40% | "B" 96% | "C" 128% | "D" $LCO_2$ |
|---|---|---|---|---|
| Density (Mg/cc at 13.5% moist. and 140 cts firmness) | 258 | 241 | 226 | 225 |

From the results of the experiments recorded in above TABLES 4 through 7 it can be seen that the results of the smaller scale experiments with the inventive process were confirmed and the optimized ratio by weight of solid gaseous carbon dioxide ($SCO_2$) to tobacco was determined to be in the range of approximately 125 to 128%. The optimized ratio was considered to be that which substantially matched the fill value improvement obtained with "$LCO_2$" treatment, and that ratios higher would involve greater $CO_2$ usage without proportionate benefit.

Referring to the drawing which presents a graph of the fill value improvements of TABLE 5 plotted against the ratio by weight of solid carbon dioxide it can be seen that as the ratio by weight increases the fill value improvement rises whether the fill value is measured by the aforedescribed vibrating compression test or the Borgwaldt test. As also can be seen in TABLE 5 the fill value improvement at a ratio by weight of 128% solid carbon dioxide to tobacco (column "C") is substantially the same as the fill value improvement for treatment of tobacco by the liquid carbon dioxide or known DIET process (column "D"). As before for TABLES 1-3, it was noted that less overall $CO_2$ was utilized and absorbed (TABLE 4) when the tobacco sample was first treated with solid carbon dioxide ($SCO_2$) and then treated with gaseous carbon dioxide ($GCO_2$) than when treated with liquid carbon dioxide alone even though fill value improvements were substantially the same.

From TABLES 6 and 7 it can also be seen that the chemical and cigarette properties at a ratio by weight of 128% solid carbon dioxide to tobacco (column "C") treated in accordance with the present invention are substantially like the chemical and cigarette properties of tobacco treated with liquid carbon dioxide (column "D") with less $CO_2$ and less energy being required in the overall inventive process.

It is to be understood that various changes can be made by one skilled in the art in the several steps of the inventive process described herein without departing from the scope or spirit of the invention.

The invention claimed is:

1. An improved tobacco treating process comprising: mixing tobacco with finely divided solid carbon dioxide at a preselected ratio of parts by weight, subjecting the solid carbon dioxide-tobacco mixture with gaseous carbon dioxide at preselected pressure, reducing the gaseous pressure, and, drying the so treated tobacco with hot gases to arrive at a final dried/expanded tobacco product.

2. The process of claim 1, said ratio by weight of solid carbon dioxide to tobacco being in the range of approximately 96% to 130%.

3. The process of claim 1, said ratio by weight of solid carbon dioxide to tobacco being approximately 128%.

4. The process of claim 1, said finely divided solid carbon dioxide being in powdered form.

5. The process of claim 1, said pressurized gaseous carbon dioxide being in the range of approximately 400-800 psig.

6. The process of claim 1, said pressurized gaseous carbon dioxide being approximately in the mid-400 psig.

7. The process of claim 1, said impregnation with gaseous carbon dioxide being for a period of approximately 2 minutes.

8. The process of claim 1, said drying step being at a temperature range of from about 250° F. to about 660° F. in the presence of an absolute humidity at a level above that which will provide a wet bulb temperature of at least about 150° F.

9. The process of claim 1, said drying step being at a temperature range of approximately 660° F. in the presence of an absolute humidity at a level above that which will provide a wet bulb temperature of approximately 210° F.

* * * * *